United States Patent [19]

Cooper

[11] Patent Number: 5,073,086

[45] Date of Patent: Dec. 17, 1991

[54] COOLED AEROFOIL BLADE

[75] Inventor: Brian G. Cooper, Derby, England

[73] Assignee: Rolls-Royce plc, London, England

[21] Appl. No.: 717,502

[22] Filed: Jun. 19, 1991

[30] Foreign Application Priority Data

Jul. 3, 1990 [GB] United Kingdom ..... 9014762

[51] Int. Cl.[5] ..... F01D 5/18

[52] U.S. Cl. ..... 416/96 R; 416/97 R

[58] Field of Search ..... 416/95, 96 R, 97 R; 415/115, 116

[56] References Cited

U.S. PATENT DOCUMENTS 4,416,585 11/1983 Abdel-Messeh ..... 415/115

4,604,031 8/1986 Moss et al. ..... 416/96 R 4,786,233 11/1988 Shizuya et al. ..... 416/90 R

*Primary Examiner*—John T. Kwon

*Attorney, Agent, or Firm*—Cushman, Darby & Cushman

[57] ABSTRACT

A gas turbine engine turbine aerofoil blade includes an aerofoil portion having pressure and suction flanks. The flanks are internally interconnected by wall member which cooperates with the flanks to define first and second cooling passage portions which are interconnected by a bend portion. The wall member is locally thickened adjacent the bend portion. In the second cooling passage portion the locally thickened wall member portion progressively increases in thickness towards at least one of the flanks so as to eliminate any acute angle between the flanks and the thickened wall member portion adjacent thereto.

6 Claims, 3 Drawing Sheets

COOLED AEROFOIL BLADE

This invention relates to a cooled aerofoil blade and in particular to a cooled aerofoil blade suitable for use in the turbine of a gas turbine engine.

The turbines of modern gas turbine engines are required to operate at extremely high temperatures and this places great demands upon the aerofoil blades present in those turbines. It is common practice therefore to provide turbine aerofoil blades with some form of internal cooling to enable them to operate in such a hostile environment. Typically such blades are provided with internal passages through which a cooling fluid, usually air, is passed.

In order to ensure blade cooling which is as effective as possible, it is known to provide cooling air passages within the blade which are of generally serpentine form. This inevitably means that the cooling air passages have bends, the angles of which are up to 180°. Unfortunately, as cooling air flows around these bends, it suffers a drop in pressure. This can lead to difficulties if, for instance, the cooling air is intended to be used subsequently for film cooling of the external surface of the blade. Film cooling requires that air is exhausted through a plurality of small holes interconnecting the internal cooling air passages with the blade exterior. Any reduction in air pressure within the internal passages will of course result in a corresponding reduction in the amount of air exhausted through these film cooling holes.

Various attempts have been made at minimising the pressure drop in cooling air as it flows around bends in passages. One attempt has comprised placing turning vanes in the passage bend. This does lead to a reduction in pressure drop but adds weight to the blade and complication of manufacture.

Another attempt which has been used particularly in respect of 180° bends comprises the modification of the internal wall of the passage. Specifically the wall is modified so that the part of the passage which divides the incoming and outgoing passage portions is locally thickened in a uniform manner so as to progressively reduce and then increase the cross-sectional area of the entrance to the outgoing passage portion in the direction of cooling air flow.

While such an arrangement does lead to a reduction in the cooling air pressure drop as it passes around the bend, the reduction is still not as great as is often desirable.

It is an object of the present invention to provide a cooled aerofoil blade having an internal cooling fluid passage which includes a bend, the passage being modified in such a manner that cooling fluid pressure drops caused by the bend are less than has heretofore been achieved.

According to the present invention, an aerofoil blade suitable for the turbine of a gas turbine engine includes a longitudinally extending aerofoil portion having pressure and suction flanks, said flanks being interconnected internally of said aerofoil portion by a generally longitudinally extending wall to partially define first and second cooling fluid passage portions disposed in side-by-side generally longitudinally extending relationship, said first and second passage portions being interconnected in series fluid flow relationship by a bend passage portion, said first passage portion being adapted to direct cooling fluid to said bend portion and said second passage portion being adapted to exhaust cooling fluid from said bend portion, said wall member being locally thickened in the region of said bend portion to provide a localised progressive series narrowing and opening of the upstream end of said second passage portion in the general direction of cooling fluid flow, said locally thickened wall member portion being so configured that at said upstream end of said second passage portion, said locally thickened wall member portion progressively increases in thickness towards at least one of said flanks so as to substantially eliminate any acute angle between said at least one flank and the thickened wall member portion adjacent thereto.

The invention will now be described, by way of example, with reference to the accompanying drawings in which.

Figure 1:
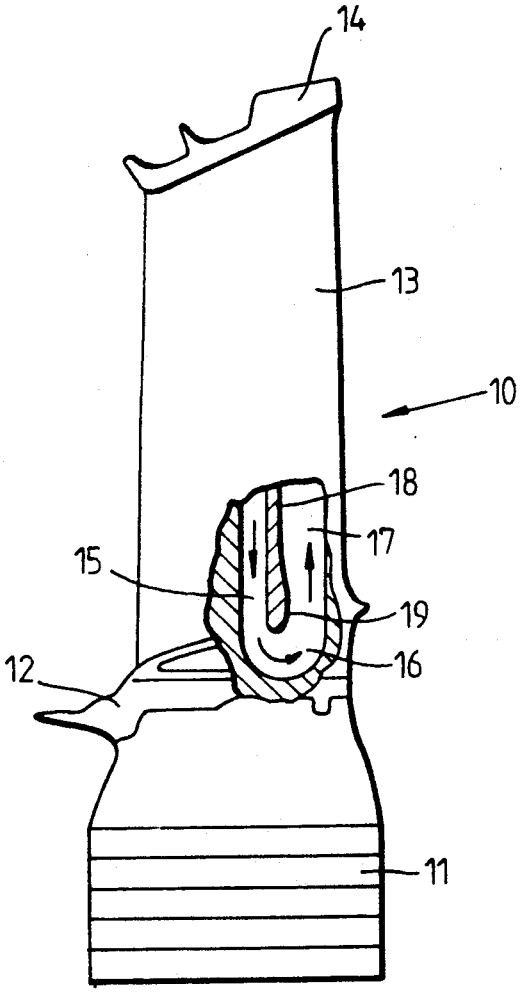
FIG. 1 is a partially sectioned side view of an aerofoil blade in accordance with the present invention.

With reference to FIG. 1, an aerofoil blade for the high pressure turbine of a gas turbine engine is generally indicated at 10. The blade 10 is conventionally mounted with a plurality of similar blades on the periphery of a disc which is located for rotation within the gas turbine engine turbine.

The blade 10 comprises a conventional root portion 11 of fir tree configuration for the attachment of the blade 10 to the previously mentioned disc. A platform 12 is located radially outwardly of the root portion 11 and an aerofoil shaped cross-section portion 13 located radially outwardly of the platform 12. A shroud portion 14 is located on the radially outermost extent of the aerofoil portion 13. Both the platform 12 and shroud portion 14 serve to define a portion of the turbine gas passage in which the aerofoil portion 13 is operationally located.

The gases which operationally flow over the aerofoil portion 13 are usually at very high temperature, and so the interior of the aerofoil portion 13 is supplied with cooling air in order to maintain an acceptable overall aerofoil temperature. If such cooling were not to be carried out, there is a likelihood that at least the aerofoil portion 13 would overheat and be damaged or even destroyed.

The cooling air utilised in cooling the aerofoil portion 13 is derived from the compressor section of the gas turbine engine in which the blade 10 is mounted. The air is directed through appropriate ducting as is well known in the art and into the aerofoil portion 13 interior. There the air flows through an appropriate configuration of passages in order to provide effective overall cooling before being ejected from the blade 10.

Effective cooling of the aerofoil portion 13 dictates that in at least one portion of the aerofoil portion 13, the cooling air is required to follow a generally U-shaped path. Thus the air is required to turn through an angle of approximately 180°. Such a path is shown in the partially sectioned portion of FIG. 1. The cooling air flows in a generally radially inward direction through a generally longitudinally extending first passage portion 15 until it reaches a bend 16 in the region of the blade platform 12. The bend turns the air through 180° to exhaust it into a second passage portion 17 through which it flows in a radially outward direction. The first and second passage portions 15 and 17 are therefore in side-by-side relationship.

The passage portions 15 and 17 are separated and partially defined by a longitudinally wall member 18 which is generally planar in configuration. However, the end 19 of the wall member 18 which, in the region of the bend portion, 16 is locally thickened as can be seen more clearly if reference is made to FIG. 2.

Figure 2:
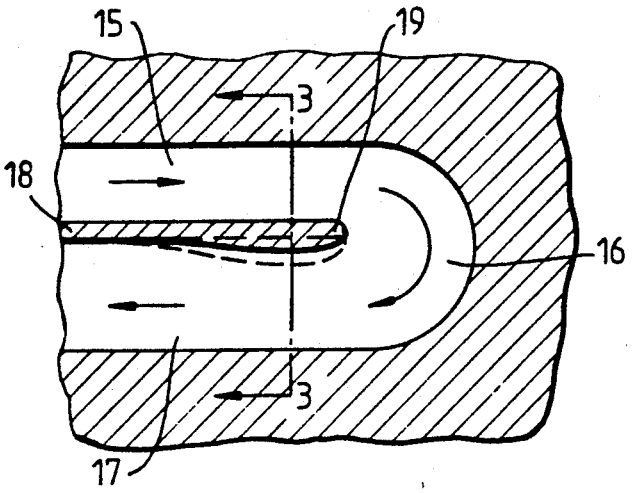
FIG. 2 is a view on an enlarged scale of the partially sectioned portion of the aerofoil blade shown in FIG. 1.
Figure 3:
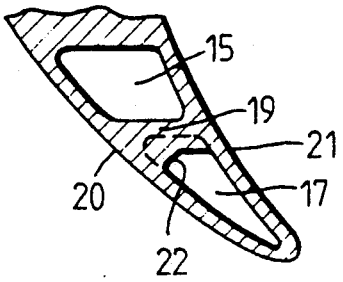
FIG. 3 is a view on section line 3—3 of FIG. 2.

Referring to FIGS. 2 and 3, the wall member 18 interconnects the suction and pressure flanks 20 and 21 respectively of the aerofoil portion 13. The flanks 20 and 21 additionally assist in defining the first and second passage portions 15 and 17.

The locally thickened end 19 of the wall member 18 is thickened so that the thickened region only protrudes into the upstream part of the second passage portion 17. This results in the upstream portion of the second passage portion 17 progressively narrowing and then opening in the direction of cooling air flow. In contrast the downstream end of the first passage portion 15 remains substantially constant in cross-sectional area.

Referring specifically to FIG. 3, the wall member 18 is angled with respect to the two aerofoil portion flanks 20 and 21. This is to facilitate easy core removal during the manufacture of the blade 10 by casting. However it is an important feature of the present invention that in the upstream region of the second passage portion 17 where the wall member 18 is locally thickened, that the significantly acute angle which would otherwise exist between the suction flank 20 and the thickened wall member end 19 is substantially avoided. This is achieved by modifying the thickness of the already thickened wall member 19 in the region of the intersection between it and the suction flank 20. Specifically the thickened wall member end 19 is further thickened in the region 22 so as to define an enlarged fillet. This ensures that in the upstream region of the second passage portion 17, the angles between the thickened wall member end 19 and the suction and pressure flanks 20 and 21 are neither significantly less than 90°.

Generally speaking, it is necessary that in the region of the upstream end of the second passage portion 17 the thickened end 19 of the wall member 18 additionally progressively increases in thickness towards at least one of the flanks 20,21 so as to substantially eliminate any acute angle between the at least one flank and the locally thickened wall member end 19 adjacent thereto.

The thickened configuration of the end 19 of the wall member 18 and the angular relationship between that end 19 of the wall member 18 and the flanks 20 and 21 is important in ensuring that the air pressure loss resulting from the cooling air flow in the first passage portion 15 being turned through 180° by the bend portion 16 is as small as possible.

In order to demonstrate the effectiveness of the present invention in minimising this pressure loss, a series of tests were carried out to compare the performance of the present invention with that of three known blade cooling configurations. The first configuration shown in FIGS. 4 and 5 had a wall member 23 which was not provided with a thickened portion. The second configuration shown in FIGS. 6 and 7 had the same non-thickened wall portion 23 but was additionally provided with a turning vane 24. The third configuration shown in FIGS. 8 and 9 had a wall member 25 which was thickened at its end in a manner similar to that of the present invention. However as can be seen most clearly in FIG. 9, there is no modification of the thickening in the region where the wall member 25 intersects the blade flanks 26 and 27. Consequently there is an acute angle 28 at the intersection of the suction surface flank 26 and the wall member 25 in the upstream portion of the second cooling fluid passage portion. This of course is in contrast to the embodiment of the present invention shown in FIGS. 2 and 3 in which such an acute angle is avoided.

In all of the devices including that of the present invention, pressurised air was directed through the first passage portion 15 to flow around the bend portion 16 and through the second passage portion 17. The static pressure of the air was monitored at various positions in both of the first and second passage portions 15 and 17.

However in order to ensure a meaningful comparison of the four different devices, their pressure ratios were calculated. Thus the measured static pressure in the second passage portion 17 was divided by the measured static pressure in the first passage portion 15.

Figure 4:
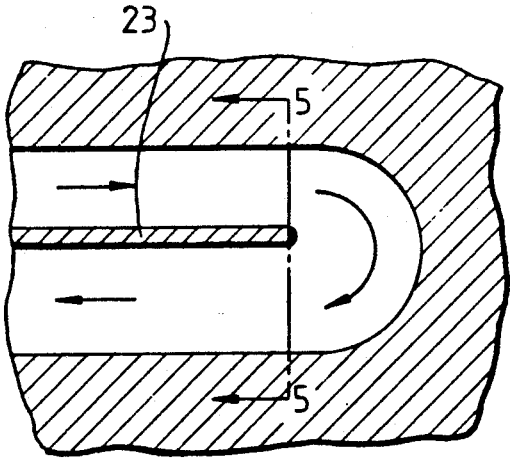
FIG. 4 is a sectioned side view similar to that of FIG. 2 but showing a prior art cooling air passage configuration.
Figure 5:
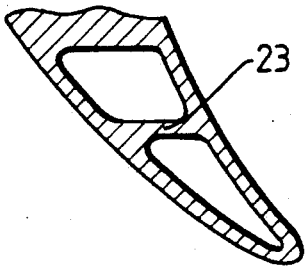
PRIOR ART Fig. 5.
FIG. 5 is a view on section line 5—5 of FIG. 4.
Figure 6:
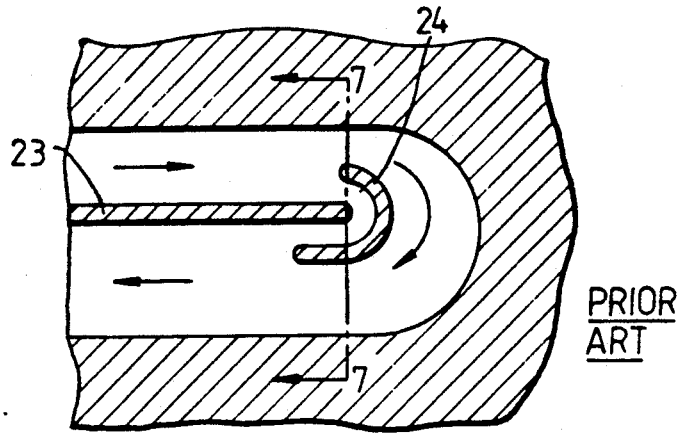
FIG. 6 is a sectional side view similar to that of FIG. 2 but showing a further prior art cooling air passage configuration.
Figure 7:
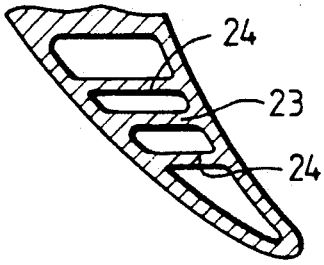
FIG. 7 is a view on section line 7—7 of FIG. 6.
Figure 8:
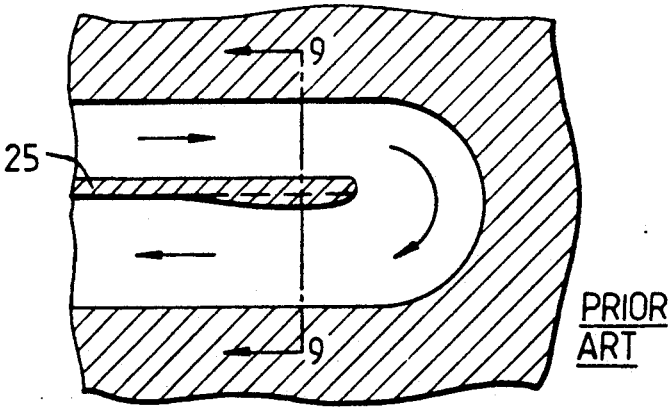
FIG. 8 is a sectional side view similar to that of FIG. 2 but showing a still further prior art cooling air passage configuration.
Figure 9:
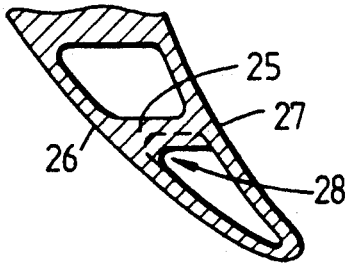
FIG. 9 is a view on section line 9—9 of FIG. 8.

In the following results A represents the peformance of the arrangement in accordance with the present invention, B represents the performance of the configuration shown in FIGS. 8 and 9, C represents the performance of the configuration shown in FIGS. 6 and 7 and D represents the performance of the configuration shown in FIGS. 4 and 5.

| Arrangement | Pressure Ratio at 200 mm from the bend centre |
|---|---|
| A | 0.933 |
| B | 0.930 |
| C | 0.922 |
| D | 0.910 |

It is clear therefore from the results that the arrangement A of the present invention results in a smaller drop in cooling air pressure resulting from parasitic losses as the air passes around the bend portion 16 than is the case with the three prior art configurations. This being so, the cooling air will be at higher pressure in the second cooling passage portion 17, thereby ensuring that the cooling can be used more effectively for, for instance, film cooling of the exterior of the turbine blade 10.

Although the present invention has been described with reference to air cooled aerofoil rotor blades, it will be appreciated that it is also applicable to stator vanes for use in the turbine of a gas turbine engine. Accordingly references in this specification to aerofoil blades should be construed as also extending to aerofoil vanes. It will also be appreciated that although the present invention has been described with reference to rotor blades have a cooling air path which turns through 180°, it is also relevant to rotor blades in which the cooling air flow is turned through angles which are somewhat less than 180°.

I claim:

1. An aerofoil blade suitable for the turbine of a gas turbine engine including a longitudinally extending aerofoil portion having pressure and suction flanks, said flanks being interconnected internally of said aerofoil portion by a generally longitudinally extending wall member to partially define first and second cooling fluid passage portions disposed in side-by-side generally longitudinally extending relationship, said first and second passage portions being interconnected in series fluid flow relationship by a bend passage portion, said first passage portion being adapted to direct cooling fluid to said bend portion and said second passage portion being adapted to exhaust cooling fluid from said bend portion, said wall member being locally thickened in the region of said bend portion to provide a localised progressive series narrowing and opening of the upstream end of said second passage portion in the general direction of cooling fluid flow, said locally thickened wall member portion being so configured that at said upstream end of said second passage portion, said locally thickened wall member portion progressively increases in thickness towards at least one of said flanks so as to substantially eliminate any acute angle between said at least one flank and the thickened wall member portion adjacent thereto.

2. An aerofoil blade as claimed in claim 1 wherein said locally thickened wall member portion progressively increases in thickness towards said suction flank.

3. An aerofoil blade as claimed in claim 1 wherein said longitudinally extending wall member is not generally normal to said pressure and suction flanks.

4. An aerofoil blade as claimed in claim 1 wherein said bend passage portion is located adjacent one of the longitudinal extents of said aerofoil portion.

5. An aerofoil blade as claimed in claim 4 wherein the longitudinal extent of said aerofoil portion adjacent which said bend passage portion is located is that which constitutes the radially inward extent of said aerofoil portion when said aerofoil blade is mounted in the turbine of a gas turbine engine.

6. An aerofoil blade as claimed in claim 1 wherein said first and second cooling passage portions are generally parallel with each other.

* * * * *